United States Patent [19]

Weinbaum

[11] 4,301,565

[45] Nov. 24, 1981

[54] METHOD AND SYSTEM FOR THE REMOVAL AND REPLACEMENT OF A BRIDGE

[76] Inventor: Irwin Weinbaum, 100 Beekman St., New York, N.Y. 10038

[21] Appl. No.: 131,827

[22] Filed: Mar. 19, 1980

[51] Int. Cl.[3] ..... E01D 1/00

[52] U.S. Cl. ..... 14/1; 52/745; 212/71

[58] Field of Search ..... 14/1; 52/745, 749; 212/27; 29/426.3

[56] References Cited

U.S. PATENT DOCUMENTS

| | | | |
|---|---|---|---|
| 1,646,725 | 10/1927 | Davidson | 14/1 X |
| 3,448,511 | 6/1969 | Suter | 14/1 X |
| 3,902,212 | 9/1975 | Muller | 14/1 |
| 3,974,618 | 8/1976 | Cortina | 52/745 |
| 3,977,147 | 8/1976 | Fletcher | 52/749 X |
| 4,054,014 | 10/1977 | Lely | 52/745 |
| 4,058,952 | 11/1977 | Donnelly | 52/749 X |
| 4,103,861 | 8/1978 | Buchler | 14/1 X |
| 4,198,797 | 4/1980 | Soble | 52/749 X |

*Primary Examiner*—Nile C. Byers, Jr.
*Attorney, Agent, or Firm*—Eliot S. Gerber

[57] ABSTRACT

A method and system for the removal and replacement of bridges, for example, steel single-span railway bridges, starts with erecting vertical columns on the existing piers or abutments of the bridge. Cross-beam means are secured to the columns, perpendicular to the length of the bridge. A plurality of jack assemblies are positioned on each cross-beam means, the jacks each acting on a high-strength rod secured to the section of the bridge to be removed. The bridge section is cut away, lifted by the jack assemblies, and then the lifted bridge section is shifted sidewise on the cross-beam means to position it over a parallel track on the intact section of the bridge. The jacks then lower the removed bridge section onto a removal means, such as a railroad car, on the intact section of the bridge. The new section of bridge is then delivered and placed in position in a similar manner.

12 Claims, 8 Drawing Figures

METHOD AND SYSTEM FOR THE REMOVAL AND REPLACEMENT OF A BRIDGE

BACKGROUND OF THE INVENTION

I. Field of the Invention

The present invention relates to methods and systems for the removal and replacement of bridge sections.

II. Description of Present Methods and Systems

At the present time one method and system used for the removal and replacement of railway bridges is called the "roll-in" method. Most railroad bridges have at least two parallel railroad tracks whose railway beds may be located on a single bridge structure.

In the "roll-in" method the first step in demolishing and replacing such a railroad bridge is to clear the site area around the bridge so that construction equipment, such as cranes, may be brought near the bridge. Frequently this is an involved, complicated and costly procedure since many railroad bridges are erected over busy highways and in congested areas. For example, many months of preparation may be required to clear the area around a railroad bridge in order to utilize a heavy-duty crane. Such preparation may involve obtaining permits, coordination among construction crews and various utility crews to relocate power, telephone and other overhead utility lines and the closing of one or more lanes of the highway for a number of weeks. Sometimes permission must be obtained to bring the equipment across, or onto, private land. Sometimes temporary haul roads must be built and the land later restored. Sometimes gravel or other suitable material must be spread on the site to provide a foundation for heavy equipment. In addition, sometimes special covers are required for underground utility lines. In addition, the highway traffic may be detoured, which may cause congestion on adjacent highways. Once the area has been cleared, a heavy-duty crane may be brought in and utilized on the site. A heavy steel temporary structure is then constructed to form a platform (ways) along the highway.

In the "roll-in" method the new bridge section is then constructed on top of the ways parallel to the existing structure. Traffic below must be stopped each time a heavy member is erected.

After the construction of the new section is complete, the old section may be removed by sliding it sidewise along the ways. This section must then be demolished over the highway below, resulting in further interference and delays.

When the old section has been disposed of, the new replacement section may be slid sidewise into position.

After all construction is complete, the ways must be dismantled and removed and the entire construction site restored.

The "roll-in" method may not be practicable with some bridges, for example, water crossings, and in those situations heavy-duty marine equipment may have to be used for the bridge's removal and replacement and such marine equipment may require preliminary dredging.

An improvement in a system to build bridges is described in U.S. Pat. No. 3,902,212 entitled "Building of Multispan Bridges Or The Like Works By The Cantilever Method."

OBJECTIVES AND FEATURES OF THE INVENTION

It is an objective of the present invention to provide a new and improved method and system for replacing railroad bridges which obviates the above-mentioned disadvantages and limitations of prior systems of this type.

It is another objective of the present invention to provide for a minimum of interferences with facilities below, such as highway traffic, with all the bridge work being accomplished from above standing on the existing bridge foundation.

It is another objective of the present invention to provide a new bridge which can be assembled off-site (away from the bridge site) and which may be placed in position without interference to the public.

It is another objective of the present invention to provide a rapid system for the demolition and replacement of bridges, thereby permitting the optimal use of labor and equipment as well as to minimize the risk of delays due to material shortages, strikes, etc.

It is another objective of the present invention to provide for the building of several bridges at one yeard for later delivery to multiple bridge sties.

It is another objective of the present invention to permit the employement of proven and readily available standard structural shapes and devices which may be handled by a work train or a small crane.

It is another objective of the present invention to provide for reusable structural components and devices so that the same structural members and devices may be employed to remove and replace a number of bridges.

It is a feature of the present invention to provide a method and system for the removal and replacement of a bridge. The bridge is built upon the existing foundations (abutments or piers) and the invention is described in relationship to demolishing a single-span bridge with minimum disturbance to traffic under the bridge. Such foundations are referred to herein as "abutments." The method involves erecting at least four vertical removable colums on the abutments at opposite corners of the bridge span. The next step is to removably connect two cross-beam means on the columns to permit the lifting of the bridge section to be removed. The two cross-beam means are separated by the length of said bridge and are parallel to its width. Preferably each cross-beam means is composed of two parallel channel shapes fabricated from wide flange beams and separated by a gap. Next, jack means are positioned on each of said cross-beam means and the jack means is attached to the bridge section. The jack means may be a center hole hydraulic jack. Then the bridge section is cut from the remainder of the bridge and lifted using said jack means, for example, by rods acted upon by center hole jacks. The cut-off bridge section is moved out of the area of the bridge span by moving the jack means sidewise on the cross-beams. Finally, the bridge section is lowered onto a removal means, such as a railway flatbed car, using the jack means. The replacement section of the bridge is delivered and installed in a similar manner.

BRIEF DESCRIPTION OF THE DRAWINGS

A better understanding of the present method and system for replacing railroad bridges may be gained by the following description, taken in conjunction with the accompanying drawings.

In the drawings.

DESCRIPTION OF PREFERRED EMBODIMENTS

Figure 1:
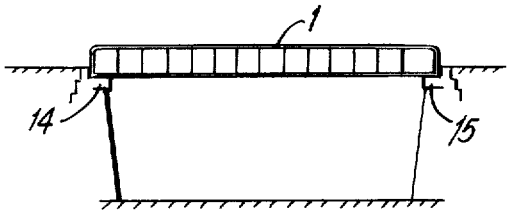
FIG. 1 is a side view of the railway bridge to be demolished, removed and replaced in accordance with the present invention.

The following detailed description of a preferred embodiment of the invention relates to a steel railway bridge 1, as shown in FIG. 1. It is a single-span bridge, that is, it is not supported by piers between its end.

The description below is applicable to multi-span bridges to be removed and replaced, according to the present invention, by applying the description of the demolition of one span of the bridge at a time. In the description below the two railroad beds are carried by parts of the same bridge structure. The present invention is also applicable to other multiple track railway bridges having three or more parallel tracks, and to certain types of highway bridges.

The bridge 1 consists of two steel side plate girders 2,3 and a center steel plate girder 4. A spaced series of parallel floor cross-beams 5,6 support two parallel railway road beds 7,8 consisting of ballasts, railroad cross-ties, and steel rails 9. Ballast is gravel or broken stone laid in a road bed of a railroad to provide a firm surface for the track, see FIG. 2.

Figure 2:
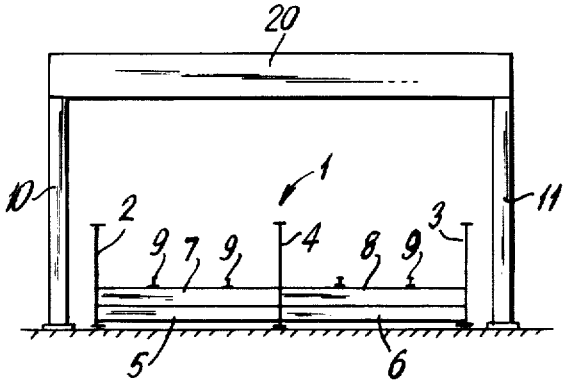
FIGS. 2 and 4–6 are front diagrammatic views of the steps of the method, and the installation of the system, of the present invention.

As shown in FIG. 2, the first stage of the procedure of the present invention for demolishing and replacing railroad bridges is the erection of four temporary columns (vertical main members) 10, 11, 12, 13 on the corners of the existing abutments 14,15 of the bridge 1. For example, the columns 10–13 may be steel 14-inch-wide flange sections. An abutment is part of a structure that directly receives thrust or pressure (as of an arch, vault, beam or strut). Generally a bridge's abutments extend beyond the bridge structure so there is room for the bases of the vertical columns 10–13. Preferably the columns are erected using respective base plates **18*a*–18*d* of columns 10–13, which base plates 18*a*–18*d* are respectively attached to the existing abutments 14–15** with anchor bolts set in a non-shrinkable grout material or an epoxy grout.

After the columns 10, 11, 12, 13 are in place, the railroad track and ballast from one half of the bridge 1 (the right half as seen in FIGS. 2–6) is removed. The one-half of the bridge 1 which is to be first removed is called the bridge section 19. After the columnns 10–13 have been erected at the abutments at four opposite corners of the bridge 1, the bridge 1 is cut in half lengthwise, but the center girder 4 and sufficient floor beams to support the dead weight load of the bridge section are left intact. Some floor beams may be cut, but floor beams 6 of the bridge must be sufficiently left intact to support the dead weight of the bridge section 19 being removed.

Figure 3:
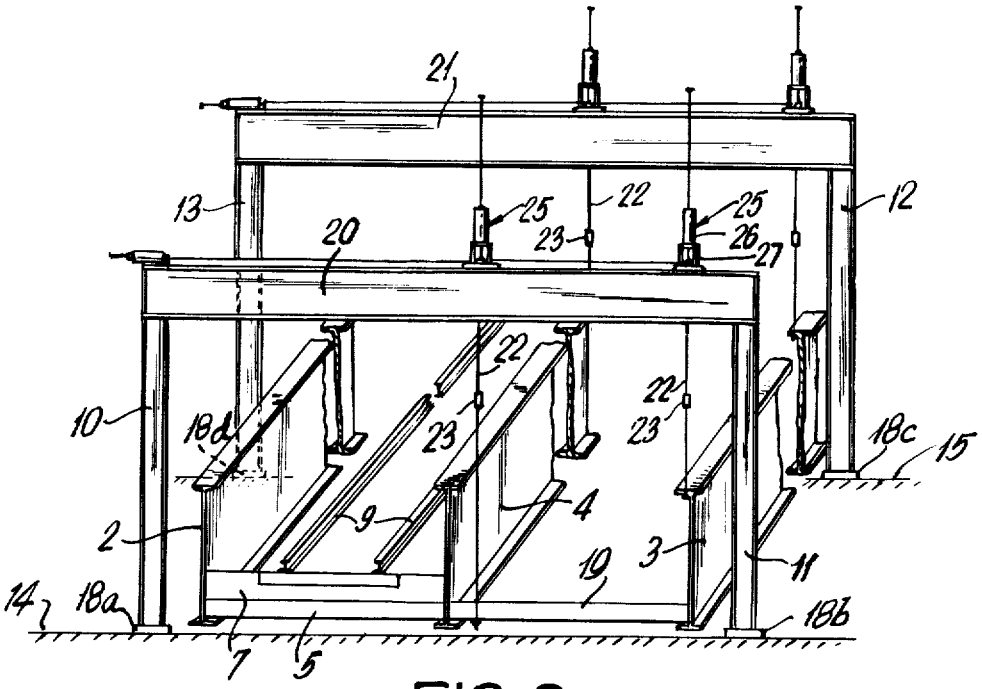
FIG. 3 is a view, partly a front view and partly a perspective view, broken away, showing a step of the present invention.

As shown in FIG. 3, the sequence of steps in the second stage of replacement is as follows. A pair of cross-beams means 20,21 are erected on columns 10,11 and 12 13, respectively. The cross-beam means 20,21 are horizontal main members. Preferably the cross-beam means are channel shapes back to back to form a double beam overhead track.

Some railroads use an electric catenary, i.e., an overhead electric cable suspended between two points. In those bridges having an electric line catenary, the cross-beam means 20,21 should be placed at least 18 inches below the electric line catenary. The cross-beam means 20,21 should be high enough to allow a train to pass below them when there is no electric catenary on the bridge.

High-strength rods 22 are then attached to the portion of the existing bridge structure to be removed, i.e., bridge section 19. This may be accomplished by having rods 22 passed through floor cross-beams 6 and attached to those floor cross-beams. The rods 22 may be in two pieces joined by coupler 23, although such couplers are not needed in bridges without an electric catenary, the rod pieces (lengths) being **22*a*, 22*b***.

Figure 7:
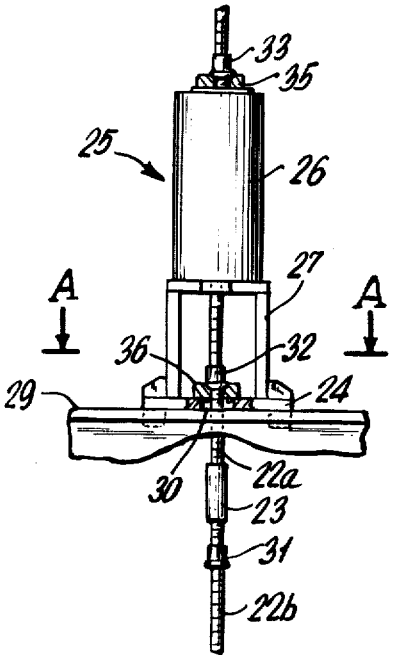
FIG. 7 is an enlarged side view of the jack assembly.

As shown in FIG. 7, each jack assembly 25 comprises a sliding base means 24, a support 27 (jack chair) and a double-acting, center hole hydraulic jack cylinder (jack) 26.

The bridge section 19 to be lifted may weigh, for example, 100 tons. The center hole jacks 26, described below, can lift loads of that weight without difficulty. Hydraulic double-acting center hold cylinders are available from Simplex-Pine Company. For example, one has a capacity of 150 tons (Model RJ 150-12) with 12-inch stroke and another has a capacity of 500 tons (RJ 50-36) with 36-inch stroke. They may be operated by air, gasoline, or electrically actuated hydraulic pumps.

The rods 22 are preferably threaded rods of the type used to post-tension reinforced concrete. Such rods are available from Dyckerhoff and Widman, Inc., under the trademark "Dywidag Threadbars". Those rods are made from hot-rolled, proof-stressed steel alloy (ASTM A722-75) with a continuous roll-in threadlike deformation along their length. They are available up to 60 feet in length with diameters of $\frac{5}{8}$ to $1\frac{3}{8}$ inches. The four $1\frac{3}{8}$ inch diameter rods (bars) are more than sufficient to lift a 100-ton load.

Each of the center hole jacks 26 is mounted on a sliding base means (carriage means) for movement on its cross-beam means. Such movement is along the cross-beam means, i.e., perpendicular to the railway tracks. An optional sliding base means is a roller skid mechanism, for example, of the type available from Multiton Inc. Four of its "Mark 5B" model dollies under "ideal conditions" (clean steel floors) are rated at 320 tons capacity.

Preferably the sliding base means is keyed to ride on the cross-beam means 20,21. For example, it may have a guide bar which rides in the gap of the cross-beam means.

Figure 8:
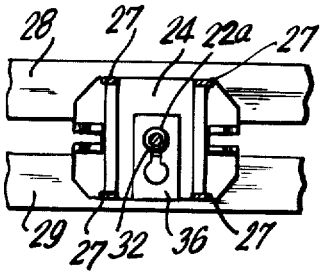
FIG. 8 is a top cross-sectional view taken along A—A of FIG. 7.

The structure and operation of the center hole jack is shown in FIGS. 7 and 8. If, as explained below, the railway has an overhead electric catenary, then two rods **22*a*,22*b* are used and held together by a coupler 23. The rod 22*a* passes through hole 30 in sliding base means 24. For simplicity, a roller dolly is not shown, but the base means 24 slides directly on the beams 28,29. If desired, a roller dolly may be used between base means 24 and the beams 28,29. A bottom anchor nut 31 is screwed onto rod 22*b* and an intermediate anchor nut 32 and a top anchor nut 33** are screwed onto the threaded rod 22*a*. The nut 33 bears on seat 35 and the nut 32 bears on the seat of bearing plate 36. The rod 22*a* passes through the center hole jack 26 positioned on support 27 which rests on base means 24.

In operation, the jack 26 lifts the nut 33 and seat 35 upwards, thereby lifting rod 22*a*. The nut 32 is rotated and turned down. When the jack 26 releases the rod 22*a* it is held in position by the nut 32 resting on its fixed bearing plate 36.

Figure 4:
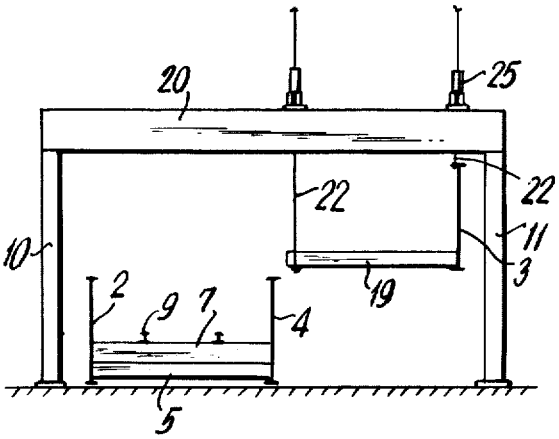

The next step in the procedure of the present invention is illustrated in connection with FIG. 4. The jack assemblies 25 are uniformly and simultaneously operated so that they lift their rods 22. The bridge section 19 is lifted to a sufficient height so that when it is carried sidewise it will clear the center girder 4.

Figure 5:
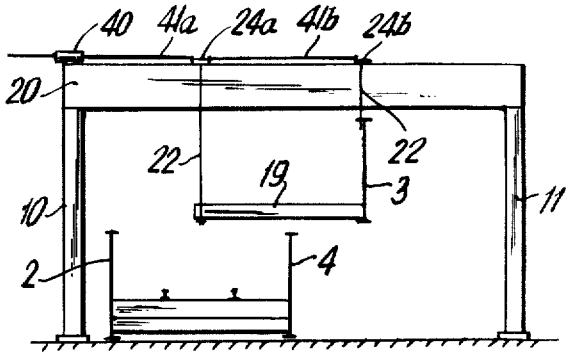

As shown in FIG. 5, the next step is to simultaneously and uniformly slide over the base means 24*a*, 24*b*. If the bridge has an electric catenary, the jacks 26 and jack supports 27 may be removed from their base means 24, the rods 22*b* being held in position by the nuts 31 seating in bearing plate 36. The sidewise motion of the base means 24, as shown in FIG. 5, may be obtained by connecting rods 41*a*, 41*b* of the same type as the rods 22 to each of the base means 24. A center hold jack mounted at the end of each of the cross-beam means (jack 40 on cross-beam means 20) pulls on the rod 41*a*, thereby pulling the base means 24*a*. The second rod 41*b* is connected between the base means 24*a*, 24*b* so that both the base means 24*a*, 24*b* are pulled simultaneously and with a fixed spacing between them. As mentioned previously, the base means may be mounted on roller dollys and all of the base means are moved simultaneously and uniformly. If the bridge does not have an electric catenary, the jacks 26 and jack supports 27 may be left in place during sidewise movement.

Figure 6:
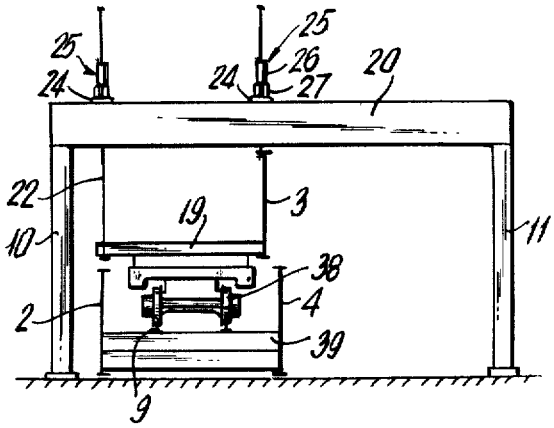

As shown in FIG. 6, the next step of the procedure involves again placing the jack supports 27 and the jacks 26 on their respective base means 24. This may be accomplished by fitting the center hole jack 26 over the upper free end of the rod 22*a*. The jacks 26 will then be operated to lower the rods 22*b*, 22*a* and thereby lower the bridge section 19 onto a flat bed railroad car 38 which rides on the rails 9 on the intact bridge section. After the bridge section 19 has been secured to the railroad car 38, the rods 22*b* are removed from the bridge section 19. The railroad car 38 is pulled away off the intact bridge section 39.

Although the illustration of the present invention in FIG. 3 utilizes four jack assemblies 25, two being slidably mounted on each of the cross-beam means, there may be used additional jack assemblies on each of the cross-beam means. For example, in certain situations it may be preferable to use three or four jack assemblies on each of the cross-beam means.

The procedure for replacing the bridge section 19 is similar, in many of its steps, to the procedure for its removal and consequently is not illustrated by a separate set of figures. The procedure utilizes the same structure as the demolition, including the columns 10–13 and the cross-beam means 20,21. Consequently, a new structure need not be erected for the positioning of the new bridge section. The procedure to bring the new prefabricated bridge section into position includes transporting the new bridge section on a railroad car and attaching it to rods which may be lifted by jack assemblies, as shown in the illustration of FIG. 6. The new bridge section is then lifted and moved sidewise (to the right in respect to FIG. 5). The new bridge section is positioned over the place where it is to be inserted (see FIG. 4) and lowered into position (see FIG. 3).

The other half of the bridge may be replaced in the same manner as the first half of the bridge. After both halves of the bridge have been replaced, the cross-beam means 20,21, the columns 10–13 and the column base plates 18*a* –18*d* are removed.

It was mentioned previously that some railways utilize an overhead electric catenary for power. If such a catenary exists, it will be necessary to remove the jack, jack support and a length of pull rod in order to clear the catenary when the bridge section is to be pulled sidewise. Such removal is shown in FIG. 5.

In order to accomplish this, as shown in FIGS. 7, 8, the pull rod 22 is furnished in two pieces 22*a*, 22*b* joined by a coupler 23 installed at a pre-figured location. A bottom anchor nut 31 is located below the coupler 23. The base means 24 includes a bearing plate 36 which allows the coupler 23 and anchor nut 31 to pass through.

Two suggested methods are:

(a) The bearing plate 36, as shown in FIGS. 7, 8, is a horseshoe-shaped plate, open on one side, which can be slipped on and off the pull rod; and it is slipped off the pull rod to allow passage of the coupler 23 and then reinserted on the rod to hold the anchor nut; or (b) The bearing plate is a plate with two openings joined together, in a keyhole shape, with one of the openings being oversized to allow passage of the coupler, see FIG. 8.

Several modifications to the above-described procedure exist. If an electric catenary exists on the bridge, it may be possible to install the cross-beams 20,21 above the catenary. In that situation, when jacking the load horizontally, as each pull rod reaches the catenary a replacement rod may be installed (ahead of the catenary) and the original rod may be removed.

The above-described invention may also be accomplished with the employment of solid jacks in lieu of center hole jacks.

Although, as mentioned above, the procedure was outlined for a single-span structure, it is also applicable to multiple-span structures. And even though the procedure outlined was for a two-track structure, it is also applicable to spans carrying more than two tracks.

A last modification to the above method is the applicability it has in replacing highway bridges or other structures instead of the replacement of railroad bridges.

The bridge illustrated in the accompanying figures is a single-span railway bridge having two parallel tracks and three parallel plate girders. The present invention is equally applicable to other types of bridge structures where (a) each track is supported independently by a pair of girders; and (b) the tracks are supported by a steel or concrete deck carried by a series of beams located below the deck and running parallel to the track.

What is claimed is:

1. A method for the removal and replacement of a bridge built upon abutments and in relationship to a single span, comprising:

erecting at least four vertical removable columns on said abutments at opposite corners of the bridge span;

removably connecting two cross-beam means on said columns to permit the lifting of a bridge section to be removed, said two cross-beam means being separated by at least the length of said bridge section and being parallel to its width;

positioning jack means on each of said cross-beam means and attaching said jack means to said bridge section;

cutting the bridge section to be removed from the remainder of the bridge;

lifting said cut-off bridge section using said jack means;

moving said cut-off bridge section out of its original area by moving said jack means on said cross-beam means;

using said jack means to lower said bridge section onto a removal means to carry away said bridge section;

using said jack means to raise a replacement bridge section;

moving said replacement bridge section on said cross-beam means over the said span; and using said jack means to lower said replacement bridge section into its replacement position.

2. The method for the removal and replacement of a bridge as claimed in claim 1 wherein said bridge is a railway bridge and said movement of said removed section after being lifted is sidewise, perpendicular to the length of said bridge, and the removal means is a railway car positioned on an intact railway bridge section parallel to said demolished bridge section.

3. The method for the removal and replacement of a bridge as claimed in claim 1 wherein the jack means on each cross-beam means comprises at least two center-hole hydraulic jacks.

4. A method for the removal and replacement of a railway bridge built upon the abutments, comprising:

erecting four vertical removable columns on said abutments near the corners of said bridge;

removably connecting a cross-beam means on each pair of said columns to permit the lifting of a bridge section to be removed, said two cross-beam means being separated by at least the length of said bridge section and being parallel to its width;

positioning at least two movable jack means on each of said cross-beam means and attaching said jack means to said bridge section;

cutting the bridge section from the remainder of the bridge;

lifting said cut-off bridge section using said jack means; and moving said cut-off bridge section out of the area of the area of the bridge span by moving said jack means on said cross-beam means.

5. A method for the removal and replacement of a bridge as claimed in claim 1 wherein:

each of said jack means is connected to said bridge section by threaded rods; and each of said jack means includes a center-hole double acting hydraulic cylinder which acts upon said rod to lift or lower said rod.

6. A method as in claim 5 and further including the steps of coupling two rods associated with each jack means, said coupling being between said jack means and said bridge section;

and rotating a nut on said rod above said beam means to retain said rod in position when released by said jack means.

7. A method for the removal and replacement of a bridge as in claim 1 wherein said bridge is a multi-span railway bridge and the said steps of the method are repeated for each span of the bridge.

8. A system for the demolition of a bridge built upon abutments and in relationship to a single span, with minimum disturbance to traffic under the bridge, comprising:

at least four vertical removable columns erected on said abutments at opposite corners of said bridge span;

two cross-beam means raised and removably connected on said columns to permit lifting of a bridge section which is to be cut and removed from the remainder of the bridge, said crossbeam means being separated by the length of said bridge span and lying parallel to its width;

movable jack means positioned on each of said cross-beam means, connecting means connecting said jack means to the bridge segment to lift said bridge section after it is cut off; and means for moving said cut-off bridge section out of the area of the bridge span by moving said jack means on said cross-beam means.

9. The system for the demolition of a bridge as claimed in claim 8 wherein said bridge is a railway bridge and said means for movement of said removed sector moves it sidewise, perpendicular to the length of said bridge, to be lowered onto a railway car positioned on a railway bridge parallel to said demolished bridge section.

10. The system for the demolition of a bridge of claim 8 wherein the jack means on each cross-beam means comprises at least two center-hole hydraulic jacks.

11. A system as in claim 8 which is for the demolition of a single-span railway bridge, wherein:

the connecting means for each of said jack means is a threaded rod;

each of said jack means includes a center-hole double-acting hydraulic cylinder which acts upon said rod to lift or lower said rod.

12. A system as in claim 11 and further including two rods associated with each jack means, coupling means connecting said two rods and being positioned between said jack means and said bridge section;

and a nut rotatably engaged on one of said coupled rods above said beam means to retain the rods in position when released by said jack means.

* * * * *